US006691345B2

(12) United States Patent
Nanahara

(10) Patent No.: US 6,691,345 B2
(45) Date of Patent: Feb. 17, 2004

(54) LIFTING MECHANISM FOR LIFTABLE SIDE RAILS FOR A LYING TABLE SUCH AS A BED

(75) Inventor: Kenji Nanahara, Funabashi (JP)

(73) Assignee: Paramount Bed Company, Limited, Tokyo (JP)

( * ) Notice: Subject to any disclaimer, the term of this patent is extended or adjusted under 35 U.S.C. 154(b) by 0 days.

(21) Appl. No.: 10/005,127

(22) Filed: Dec. 7, 2001

(65) Prior Publication Data

US 2003/0106151 A1 Jun. 12, 2003

(51) Int. Cl.[7] ..... A47C 21/08
(52) U.S. Cl. ..... 5/430; 5/428; 5/425
(58) Field of Search ..... 5/424, 425, 428, 5/430, 503.1, 507.1, 658, 662, 100

(56) References Cited

U.S. PATENT DOCUMENTS 1,059,515 A * 4/1913 Barr ..... 5/428
1,442,914 A * 1/1923 Stoll ..... 5/428 X
2,587,291 A * 2/1952 Des Rochers ..... 5/430
2,799,869 A * 7/1957 Leone et al. ..... 5/430
2,976,548 A * 3/1961 Maertins ..... 5/100 X
3,055,020 A * 9/1962 Mann ..... 5/430
3,063,066 A * 11/1962 Peck et al. ..... 5/430 X
3,093,839 A * 6/1963 Higgins ..... 5/429
3,234,570 A * 2/1966 Hutt ..... 5/430
3,336,609 A * 8/1967 Taylor ..... 5/430
3,351,961 A * 11/1967 Daniels et al. ..... 5/430
3,840,917 A * 10/1974 Taylor ..... 5/430
6,446,283 B1 * 9/2002 Heimbrock et al. ..... 5/425
6,564,404 B1 * 5/2003 Nanahara ..... 5/430
2003/0019035 A1 * 1/2003 Heimbrock et al. ..... 5/428
2003/0106151 A1 * 6/2003 Nanahara ..... 5/430

* cited by examiner

*Primary Examiner*—Robert G. Santos
(74) *Attorney, Agent, or Firm*—Townsend & Banta

(57) ABSTRACT

The pair of support arms connected with the respectively horizontal both sides of the plural side rail members lift and lower the side rail proper consisting of a plurality of side rail members by the pivotal rotation of the support arms along the pivotally rotational loci between the high service position and the low stored position. In this motion, the connection points between the support arms and the side rail members are disposed in such a manner that the connection points of the upper side rail member make pivotally rotational motion relatively delayed in phase, with the connection points of the lowest side rail member as the fulcrums, when the side rail members are moved to descend by the pivotally rotational motion of the support arms. The side rail proper consisting of vertically disposed plural side rail members becomes smaller in the vertical height at the low stored position than at the high service position, the distance between the bottom of the side rail and the floor surface at the stored position can be kept large while keeping the bed deck height low and keeping vertical height at the service position sufficiently high.

20 Claims, 9 Drawing Sheets

LIFTING MECHANISM FOR LIFTABLE SIDE RAILS FOR A LYING TABLE SUCH AS A BED

FIELD OF THE INVENTION

The present invention relates to side rails disposed above the deck on one lateral side for preventing the bedding such as a bed quilt and a user such as a patient from falling, particularly a lifting mechanism for liftable side rails, in which side rails can be lifted and lowered between the service position above the deck and the stored position below the deck.

BACKGROUND OF THE INVENTION

The conventional side rails to be disposed above the deck on one lateral side of a lying table such as a bed or stretcher include, as described later, a detachable side rail consisting of a side rail proper and columns which are inserted into the fitting holes formed in a lateral side of the deck, for supporting the side rail proper in its service condition, and a liftable side rail in which a side rail proper is supported liftably by any proper lifting mechanism, to be used at a lifted position and to be stored at a lowered position for avoiding any disturbance by the top of the side rail proper. They also include an full side rail to cover an entire lateral side of a lying table, and a partial side rail to cover an entire lateral side of a lying table in combination with other side rails, usually another side rail.

As an example of lying tables, medical beds are being specified in dimensions of respective portions by standards to allow their safe use. For example, for partial side rails, for example, IEC specifies the dimensions of respective portions as described below in reference to FIG. 8.

The components of FIG. 8 will be explained at first. Symbol 1 denotes the deck of a bed, and the deck 1 is liftably supported above a base 2 by any proper link mechanism 3, and can be driven to be lifted and lowered by a drive mechanism not illustrated. Symbol 4 denotes a partial side rail which is supported by any proper support mechanism at one lateral side of the deck 1 in its service condition. Two such partial side rails 4 are installed side by side, to cover the entire lateral side of the deck 1. Each of the partial side rails consists of a side rail proper 5 and columns 6 which are inserted into the fitting holes (not illustrated) formed in a lateral side of the deck 1. As for other illustrated components, symbol 7 denotes a mattress placed on the deck 1; 8, a head board; and 9, a foot board.

The specified dimensions of the respective portions shown in FIG. 8 are described below.

The dimension indicated by A shows the dimension of each closed space formed in the side rail proper 5 of the side rail 4, when the side rail proper 5 is a lattice with spaces in it. The dimension of each space is specified to be 120 mm or less, to prevent that the head of the user enters into the space.

The dimension indicated by D is the dimension of the gap between the side rails proper 5 of the adjacent side rails 4, or the dimension of the gap between the side rail proper 5 on the head board side and the head board 8 or between the side rail proper 5 on the foot board side and the foot board 9. The dimension of any of the gaps is specified to be 60 mm or less to prevent that the neck of the user enters into the gap, or to be 235 mm or more, to prevent that the head is caught in the gap.

The dimension indicated by F is the dimension of the gap between the bottoms of the side rails proper 5 and the deck 1 when there is an open space above the gap. The dimension of the gap is specified to be 120 mm or less to prevent that the head enters into the gap when the neck cannot enter into the above opening, or to be 60 mm or less to prevent that the neck goes into the gap below the side rails proper 5 when the neck can enter into the above opening.

G1 and G2 indicate the horizontal lengths of the side rails proper 5 of the respective side rails 4, and are specified to satisfy a formula of G1+G2>L/2, where L is the total length L of the deck 1.

The dimension indicated by H is the height of the side rails proper 5 of the side rails 4, i.e., the dimension between the upper surface of the mattress 8 and the tops of the side rails proper of the side rails 4, being specified to be 220 mm or more.

The dimensions of respective portions of the partial side rails described above are applied also when liftable side rails proper are used at a lifted position.

A conventional example of liftable side rails, particularly partial side rails is described below in reference to FIG. 9.

In FIG. 9, symbol 11 generally denotes a bed equipped with liftable side rails. In this drawing, the detailed structure of the bed is not illustrated, and some components only are indicated by two-dot-dash lines.

Symbol 12 denotes a deck to have a mattress (not illustrated) placed on it, and the deck 12 is divided into four deck portions, i.e., four deck portions 12*a*, 12*b*, 12*c* and 12*d* respectively corresponding to the back, waist, thigh and legs of the user. They are respectively connected to allow pivotal rotation. The deck 12 consisting of these deck portions is supported above a deck support frame 13. Particularly, at first, the deck portion 12*b* is stationarily supported on the deck support frame 13. The deck portions 12*a* and 12*c* are pivotally rotatably connected with the deck portion 12*b* as described above, and pivotally rotatably and liftably supported by boost arms 14*a* and 14*c* which are components of a drive mechanism (not illustrated). Said support mechanism and drive mechanism are not illustrated, since they are well-known.

The deck support frame 13 is supported by any appropriate support mechanism on the floor 15 of a room, etc. The support mechanism is not illustrated. For example, the deck support frame 13 can be supported at a predetermined height by stands or can be liftably supported by a lifting link mechanism above a base as shown in FIG. 8. In FIG. 9, symbol 16 denotes a head board, and 17, a foot board.

On the head board side and the foot board side of the deck support frame 13, respectively one pair of support arms 18*a* and 18*b* are supported pivotally rotatably around the rotary shafts extending in the transverse direction of the bed. At the tips of the pair of support arms 18*a* and 18*b*, side rails proper 19*a* and 19*b* are pivotally rotatably connected, to form a parallel motion link mechanism. The support arms 18*a* and 18*b* can also be pivotally rotatably supported on the deck portions 12*a*, 12*c*, etc., not on the deck support frame 13.

In the above constitution, the side rails proper 19*a* and 19*b* are lifted and lowered by the pivotally rotational motion of the support arms 18*a* and 18*b* in parallel along the pivotally rotational loci. The condition that they are held at a lowered position is the stored condition, and the condition where they are held at a lifted position is the service condition. The side rails proper 19*a* and 19*b* are schematically drawn by their outer frames only, but have components such as lattice members to satisfy the above mentioned standard dimensions, and though the holding mechanism for the service condition and the stored condition is not illustrated, any well-known adequate mechanism can be used.

As described above, the liftable side rails, the side rails proper of which are liftably supported by any proper lifting mechanism in the service condition at the lifted service position and also in the stored condition at the lowered stored position, must conform to the standard dimensions as described above in the service condition. However, also in the stored condition, there are desirable dimensions in view of convenience. That is, in the use of the bed shown in FIG. 9. when the side rails are held at the stored position, it can happen that an attendant nurses the user such as a patient lying on the bed, or that the table plate of a movable bed side table is moved and located above the bed. In the former case, it can happen that the attendant inserts his/her legs into the gap formed between the bottoms of the side rails proper in the stored condition and the floor 15 of the sickroom, etc., and in the latter case, the base of the bed side table is moved inside the gap. So, it is desirable that the gap h is larger.

On the other hand, recently there is a tendency to keep the bed deck height low, because of various advantages that the user such as a patient can easily get on and off the bed deck and sit at the edge of the deck 12 and that the attendant can more easily nurse if the bed is low in deck height.

In the liftable side rails, the side rails proper of which can be lifted and lowered in parallel by the pivotal rotation of the support arms, it is a contradictory challenge to keep the bed deck height low, while keeping the distance h between the bottoms of the side rails proper and the floor surface large.

The reason is that, if it is attempted to keep the distance h between the bottoms of the side rails proper and the floor surface large while keeping the height H of the side rails proper shown in FIG. 8 sufficiently high (this is necessary for safety), the positions where the support arms are fixed, hence the position of the bed deck must be kept high.

So, hitherto, these dimensions are set considering the above mentioned contradictory challenge, and it is very difficult to keep the distance h between the bottoms of the side rails proper and the floor surface large while keeping the bed deck height low and keeping the height H of the side rails proper sufficiently high.

SUMMARY OF THE INVENTION

This invention has been conceived in view of the above. The object of this invention is to provide a lifting mechanism for liftable side rails, in which the side rails proper thereof can be lifted and lowered by the pivotal rotation of support arms along the pivotally rotational loci, characterized by allowing the height H of the side rails proper to be kept sufficiently high at the service position while allowing the distance h between the bottoms of the side rails proper and the floor surface to be kept large at the stored position.

This object can be achieved by a lifting mechanism for side rails, comprising each of the side rails proper, consisting of a plurality of vertically disposed side rail members, the plurality of side rail members, being pivotally rotatably connected, on the respectively both horizontal sides thereof, with a pair of support arms pivotally rotatably supported at side rail installation points of the lying table such as a bed, to be supported in such a manner that the side rail members may be lifted and lowered by the pivotally rotational motion of these support arms along the pivotally rotational loci, and the connection points between the support arms and the side rail members, being disposed in such a manner that the connection points of the upper side rail member make pivotally rotational motion relatively delayed in phase, with the connection points of the lowest side rail member as the fulcrums, when the side rail members are moved to descend by the pivotally rotational motion of the support arms.

In this lifting mechanism for side rails, the pair of support arms connected with the respectively horizontal both sides of the plural side rail members lift and lower the side rail proper consisting of a plurality of side rail members by the pivotal rotation of the support arms along the pivotally rotational loci between the high service position and the low stored position.

In this motion, the connection points between the support arms and the side rail members are disposed in such a manner that the connection points of the upper side rail member make pivotally rotational motion relatively delayed in phase, with the connection points of the lowest side rail member as the fulcrums, when the side rail members are moved to descend by the pivotally rotational motion of the support arms. Therefore, the pivotally rotational stroke of the support arms free from the mutual interference of the respective components of the mechanism, hence the lifting stroke of the lowest side rail member can be made large to allow the stored position and the service position to be disposed preferably.

Furthermore, since the side rail proper consisting of vertically disposed plural side rail members becomes smaller in the vertical height at the low stored position than at the high service position, the distance between the bottom of the side rail and the floor surface at the stored position can be kept large while keeping the bed deck height low and keeping vertical height at the service position sufficiently high.

In this lifting mechanism for side rails, the connection points between the respective side rail members and the support arms can be disposed in such a manner that the distances between the respective connection points in the vertical direction become longest during the descending motion of the side rail members by the pivotally rotational motion of the support arms.

In this constitution, the distance between the respective side rail members does not monotonously become large in the motion from the stored position to the service position, but becomes maximum during the motion and becomes a little smaller again. So, it can be prevented that the gap between the respective side rail members becomes too large at the service position.

In the above side rail support mechanism, it is preferable in the application of this invention, that the plurality of side rail members are connected with the support arms, to form a parallel motion link mechanism. However, it is not necessarily required to form a perfect parallel motion link mechanism, and an adequately shifted four-node link mechanism can also be adopted.

Furthermore, in the above side rail support mechanism, the side rail can consist of vertically disposed two side rail members, and the lower side rail member can have an outside form of being smaller in vertical height on the front side of the descending motion, than on the rear side, and having a step to make a vertically extended portion at the top on the rear side, while the upper side rail member can have an external form of being larger in vertical height on the front side than on the rear side, and having a step to make a vertically extended portion at the bottom on the rear side.

In this constitution, at the service position, the lower side rail member and the upper side rail member can be disposed with a predetermined distance kept between them, while the front side and the rear side of the lower side rail member face the front side and the rear side of the upper side rail member, and therefore, the vertical height of the side rail proper can be kept large. Furthermore, at the stored position, the lower side rail member and the upper side rail member can be disposed with a predetermined distance kept between them, while the front side of the lower side rail member faces the rear side of the upper side rail member, and therefore, the vertical height of the side rail proper can be kept small.

Moreover, the side rail can consist of three or more rail-shaped side rail members, and in this case, a connecting link can be connected between the intermediate points of the rail-shaped side rail members, to form a parallel motion link mechanism.

In the above lifting mechanism for side rails, the support arms can be connected at the ends of the respective side rail members.

In this constitution, since an upwardly open space is not formed below the side rails proper, it is not necessary to consider the dimension indicated by F of FIG. 8 described in the explanation of a standard for the dimensions of side rails.

Furthermore, in the lifting mechanism for side rails, each of the support arms can be a bent link, in which, from the tip of a first arm portion extending from the side rail installing point of the lying table such as a bed to the lowest side rail member, a second arm portion can be protruded toward the rear side of the descending motion. Each of the support arms can also be formed by a plate free from any bent portion.

In the above lifting mechanism for side rails, two side rails can be provided on front and rear sides at one lateral side of the lying table such as a bed, to cover the lateral side entirely, or one side rail can be provided to cover the lateral side entirely.

In the former partial side rails, the side rails on the front and rear sides can be lowered to keep the side rails proper thereof stored near the ends of the lying table such as a bed.

DETAILED DESCRIPTION OF THE PREFERRED EMBODIMENTS

Preferred embodiments of this invention are described below in more detail in reference to attached drawings.

Figure 1:
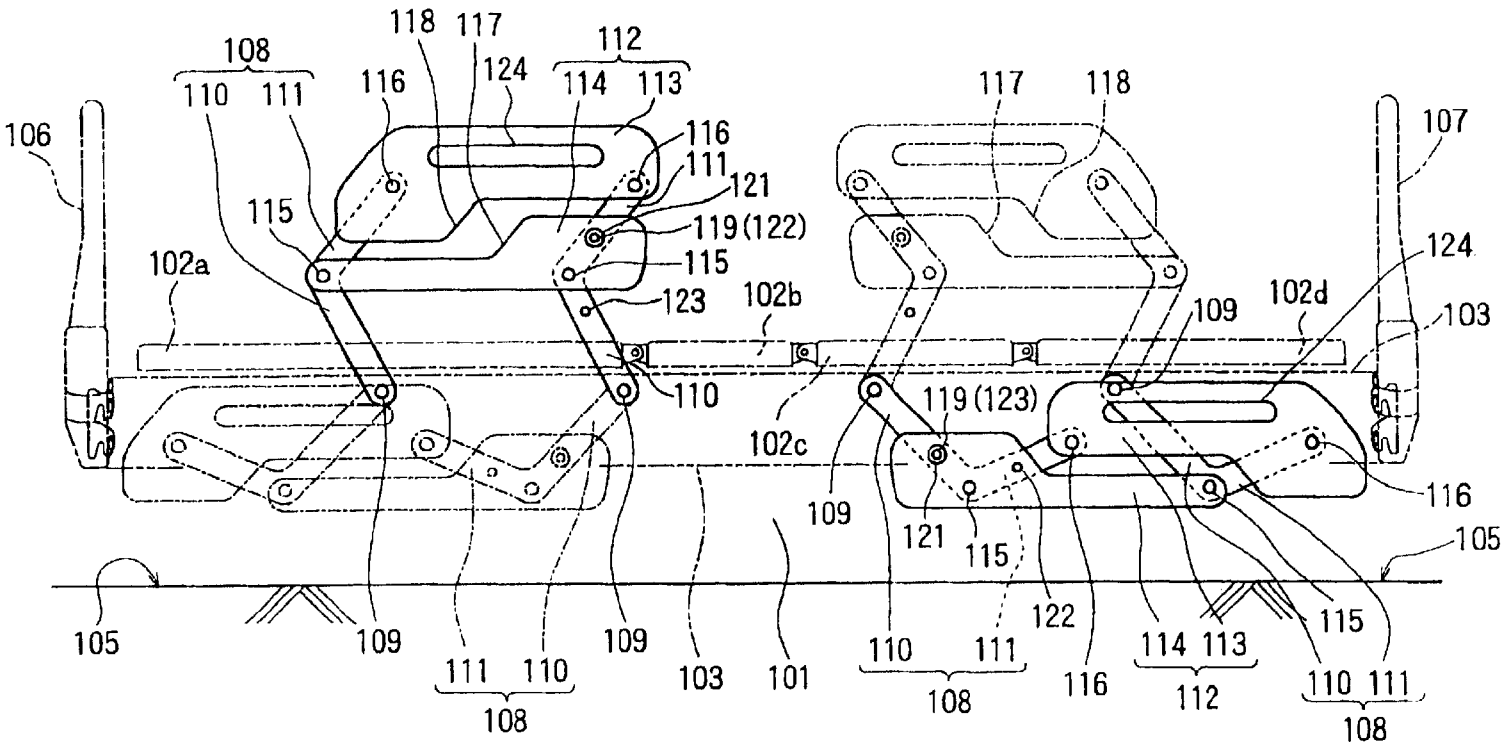
FIG. 1 is a side view showing a preferred embodiment, in which the lifting mechanism for side rails of this invention is applied to a lying table, particularly a bed.

FIG. 1 shows a first preferred embodiment, in which the lifting mechanism for side rails of this invention is applied to a bed.

Figure 9:
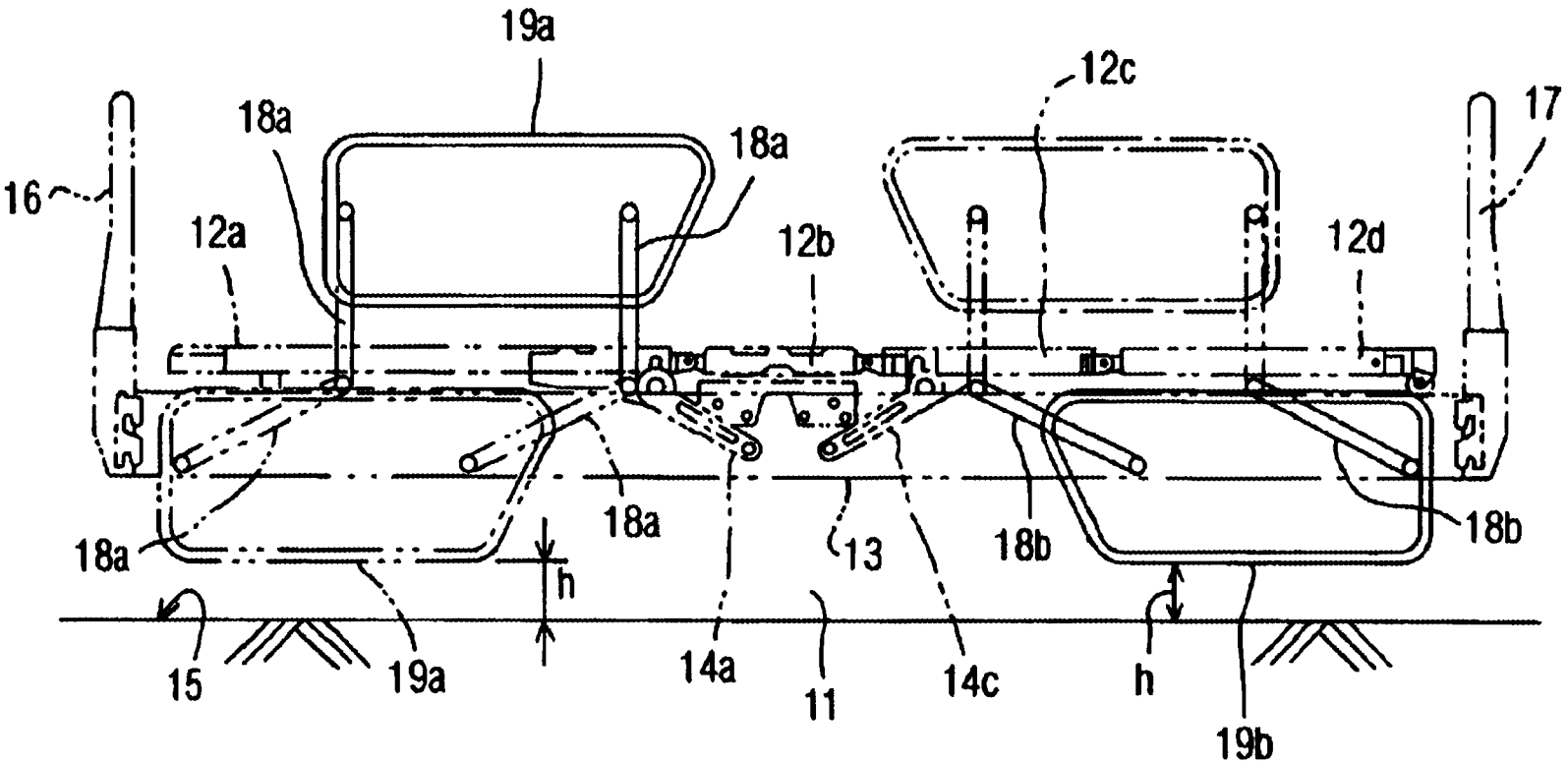
FIG. 9 PRIOR ART
FIG. 9 is a side view for showing a bed to which a conventional lifting mechanism for partial side rails is applied.

In FIG. 1, symbol 101 generally denotes a bed. In the drawing, the detailed structure of the bed is not illustrated as in the case of FIG. 9 showing a conventional example, and some components only are indicated by two-dot-dash lines.

Symbol 102 denotes a bed deck on which a mattress (not illustrated) is placed, and the deck 102 is divided into four deck portions, i.e., four deck portions 102*a*, 102*b*, 102*c* and 102*d* respectively corresponding to the back, waist, thigh and legs of the user. They are connected to allow pivotal rotation respectively. The deck 102 consisting of these deck portions are supported above a deck support frame 103. Particularly, the deck portion 102*b* is stationarily supported on the deck support frame 103. The deck portions 102*a* and 102*c* are pivotally rotatably connected with the deck portion 102*b* as described above, and pivotally rotatably supported by boost arms which are components of a drive mechanism (not illustrated).

Figure 8:
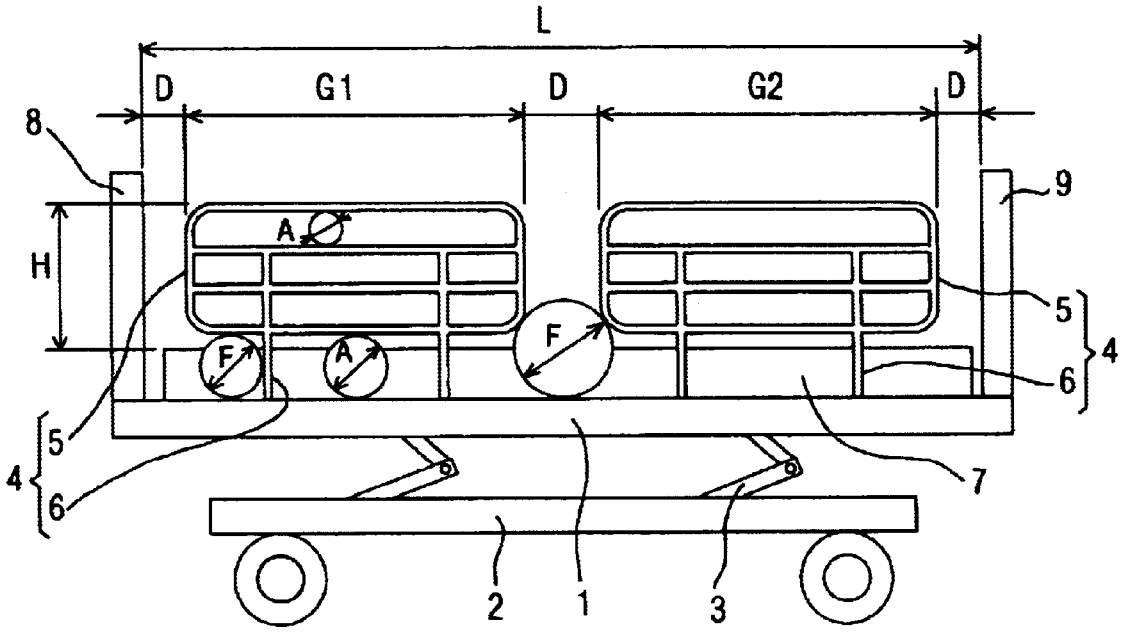
FIG. 8 PRIOR ART
FIG. 8 is a side view for illustrating an standard for dimensions of respective portions of partial side rails in a bed.

The deck support frame 103 is supported by any proper support mechanism on the floor 105 of a room, etc. The support mechanism is not illustrated. For example, the deck support frame 103 can be supported at a predetermined height by stands or can be liftably supported by a lifting link mechanism above a base as shown in FIG. 8. In FIG. 1, symbol 106 denotes a head board, and 107, a foot board.

On the head board 106 side and the foot board 107 side of the deck support frame 103, pairs of support arms 108 are supported pivotally rotatably around the rotary shafts extending in the transverse direction of the bed 101. The pivotally rotational fulcrums of these support arms 108 are indicated by 109 in the drawing. In the following description, pairs of components are indicated by the same symbols like this respectively for the sake of convenience.

Each of the support arms 108 is a bent link bent at an intermediate portion, and it consists of a lower arm portion 110 and an upper arm portion 111 so called in a condition where the side rail proper 112 described later is at the service position.

When the side rail proper 112 is at the service position, the support arms 108 on the head board 106 side are bent with a narrow angle formed on the foot board 107 side, and the support arms 108 on the foot board 107 side are bent with a narrow angle formed on the head board 106 side.

These support arms 108 are designed to ascend with the narrow angle side as the front side and to descend with the narrow angle side as the rear side.

That is, the support arms 108 on the head board 106 side are designed to be clockwise pivotally rotated to ascend, and to be counterclockwise pivotally rotated to descend. On the other hand, the support arms 108 on the foot board 107 side are designed, on the contrary, to be clockwise pivotally rotated to descend and to be counterclockwise pivotally rotated to ascend.

Symbols 112 indicate the side rails proper on the head board 106 side and the foot board 107 side. These side rails proper 112 respectively consist of an upper side rail member 113 and a lower side rail member 114. They are connected with the support arms 108, to form the side rails.

The lower side rail member 114 is pivotally rotatably connected with the tip of the lower arm portion 110, and the upper side rail member 113 is pivotally rotatably connected with the tip of the upper arm portion 111. The connection points between the lower side rail member 114 and the support arms 108 are indicated by symbols 115, and the connection points between the upper side rail member 113 and the support arms 108, i.e., the tips of the upper arm portions 111 are indicated by symbols 116. These connection points 115 and 116 and the above pivotally rotational fulcrums 109 have appropriate hinge mechanisms to allow pivotally rotational motion.

The lower side rail member 114 has an external form of being smaller in vertical height on the front side of the descending motion of the side rail proper 112, i.e., on the left side in the left side rail proper 112 or on the right side in the right side rail proper 112, than on the rear side, and having a step 117 to make a vertically extended portion at the top on the rear side. Furthermore the upper side rail member 113 has an external form of being larger in vertical height on the front side of the descending motion of the side rail proper 112 than on the rear side, and having a step 118 to make a vertically extended portion at the bottom on the rear side.

In FIG. 1, on the head board 106 side, the components of the side rail held in the service condition at the service position are drawn by solid lines, and the components of the side rail held in the stored condition at the stored position are drawn by one-dot-dash lines. However, on the foot board 107 side, on the contrary, the components of the side rail held in the service condition at the service position are drawn by one-dot-dash lines and the components of the side rail held in the stored condition at the stored position are drawn by solid lines.

As illustrated, in the side rail proper 112 held in the service condition at the service position, the lower side rail member 114 and the upper side rail member 113 are disposed with a predetermined distance kept between them, while the front side and the rear side of the lower side rail member 114 face the front side and the rear side of the upper side rail member 113, and at the stored position, the lower side rail member 114 and the upper side rail member 113 are disposed with a predetermined distance kept between them, while the front side of the lower side rail member 114 faces the rear side of the upper side rail member 113.

As can be seen from the above, the distance from the top edge of the upper side rail member 113 to the bottom edge of the lower side rail member 114, i.e., the vertical height of the side rail proper 112 is smaller in the stored condition than in the service condition. In other words, the vertical height of the side rail proper 112 which is small in the stored condition becomes large in the service condition.

A preferred embodiment of the motion of the components of the side rail from the stored position to the service position and from the service position to the stored position and of the mechanism for holding the side rail proper at the stored position and the service position is described below in reference to FIG. 1 and also to FIGS. 2 and 3.

Figure 2:
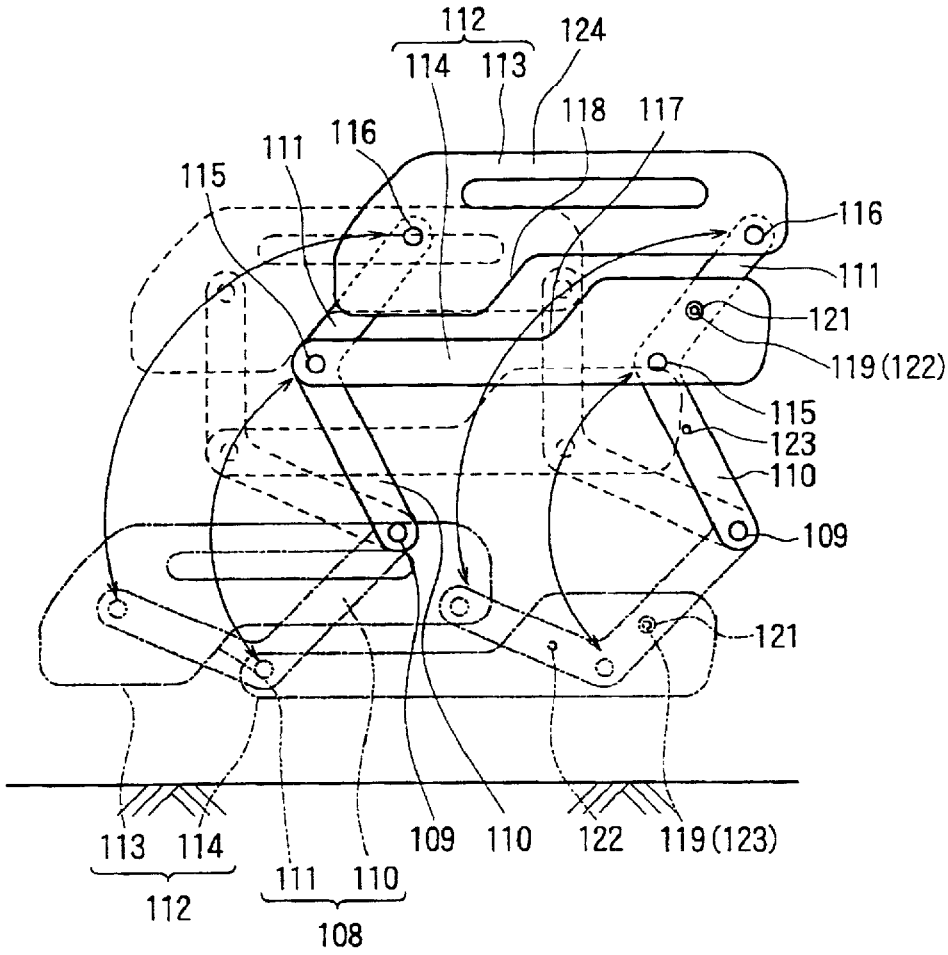
FIG. 2 is an expanded illustration for illustrating the action of an important portion of FIG. 1.
Figure 3:
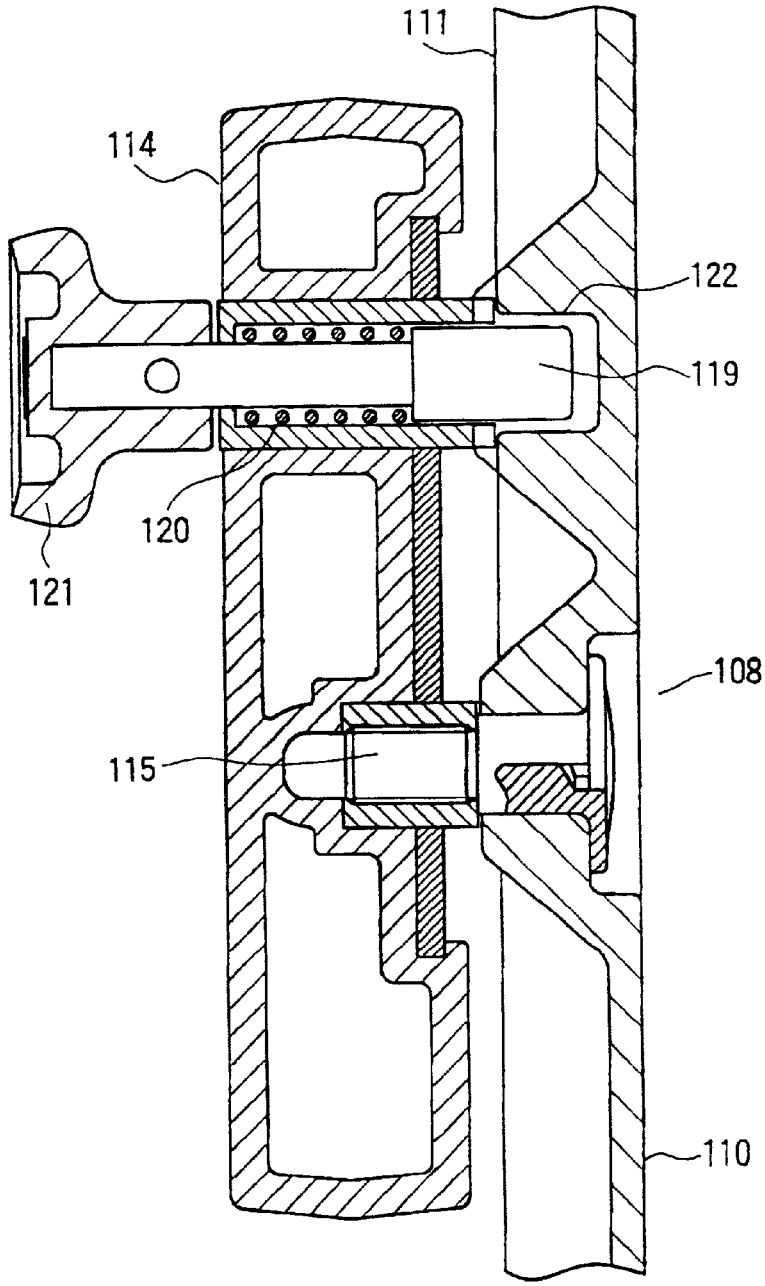
FIG. 3 is a sectional view showing a preferred embodiment of a stopper mechanism for holding the side rail at the service position and the stored position.

FIG. 2 is an expanded illustration of the side rail on the head board 106 side of FIG. 1, and FIG. 3 is a partial sectional view showing the holding mechanism of FIG. 2. The components corresponding to those of FIG. 1 are indicated by the same symbols, to avoid double explanation. However, in FIG. 2, in addition to the components of the side rail held at the stored position and the service position, the components of the side rail at an intermediate position in the ascending and descending motion are indicated by broken lines.

A preferred embodiment of the mechanism for holding the side rail proper 112 will be at first described in reference to FIG. 3. In FIG. 3, symbol 119 denotes a stopper pin set in the lower side rail member 114, protrudably toward the arm portion 111, and the stopper pin 119 can be protruded toward the arm portion 111 by the resilience of a compression coil spring 120 and can be retracted by pulling a control knob 121. A fitting hole 122 into which the stopper pin 119 can be protruded is formed in the arm portion 111.

In reference to FIG. 2, a fitting hole into which the stopper pin 119 can be fitted is formed not only in the upper arm portion 111, but also in the lower arm portion 110 as indicated by symbol 123 in FIG. 2, though not illustrated in FIG. 3. The fitting holes 122 and 123 are located on the same circle around the connection point 115.

In the solid line condition of FIG. 2, the stopper pin 119 is fitted in the fitting hole 122 of the upper arm portion 111, and because of it, the support arm 108 cannot be pivotally rotated around the connection point 115 relatively to the lower side rail member 114.

For this reason, the lower side rail member 114, the pair of support arms 108 and the upper side rail member 113 which are components of a four-node link mechanism are held in the solid line condition of FIG. 2, and this held position is the service position of the side rail proper 112.

In the service condition held at the service position like this, the vertical distance between the upper side rail member 113 and the lower side rail member 114 is kept at a predetermined value, and thus, the height of the side rail proper 112 can be set at a height in conformity with the standard.

To relocate the side rail proper 112 from the service condition to the stored condition, at first, the control knob 121 is pulled, to retract the stopper pin 119 from the fitting hole 122. As a result, the support arms 108 as components of the four-node link mechanism can be pivotally rotated around the connection point 115 relatively to the lower side rail member 114. So, the support arms 108 can be pivotally rotated, for example, by manually manipulating the handling portion 124 provided at the top of the side rail member 113, to allow the upper and lower side rail members 113 and 114 to descend along the pivotally rotational loci.

As described before, the descending of the side rail members 113 and 114 is caused, as illustrated, by the pivotal rotation of the support arms 108 bent at the connection points 115 with the small angle side as the rear side, i.e., by the counterclockwise pivotal rotation of the support arms in FIG. 2.

If the pair of support arms 108 are pivotally rotated counterclockwise, the lower side rail member 114 descends in parallel along the pivotally rotational loci of the connection points 115 with the tips of the lower arm portions 110 (or the bases of the upper arm portions 111), and the upper side rail member 113 descends in parallel along the pivotally rotational loci of the connection points 116 with the tips of the upper arm portions 111.

In this case, the pivotal rotation of the upper arm portions 111 delays in phase relatively to the pivotal rotation of the lower arm portions 110, when the upper arm portions 111 are pivotally rotated relatively to the lower side rail member 114 with the connection points 115 as the fulcrums, since the upper arm portions 111 are bent rearward from the connection points 115 relatively to the lower arm portions 110.

That is, when the lower side rail member 114 gradually descends along the pivotally rotational loci of the lower arm portions 110, the upper side rail member 113 is moved to gradually leave upward from the lower side rail member 114 by the upper arm portions 111. And the upper side rail member 113 is kept upward farthest away from the lower side rail member 113 when the upper arm portions 111 stand vertically as indicated by broken lines in the drawing. Thereafter, the upper side rail member 113 gradually approaches the lower side rail member 114 in the vertical direction and descends while gradually moving horizontally, i.e., leftward, to reach the position indicated by two-dot-dash lines in the drawing.

At this position, the stopper pins 119 correspond to the fitting holes 123 formed in the lower arm portions 110, and are protruded into the fitting holes 123 by the resilience of the compression coil springs 120, and in the same condition as described above, the support arms 108 cannot be pivotally rotated relatively to the lower side rail member 114. So, the upper side rail member 113 and the lower side rail member 114 are held at the lowered position, and the position is the stored position of the side rail proper 112.

The side rail proper 112 can be relocated from the stored position to the service condition by taking an action reverse to the above. In this case, in this preferred embodiment, the connection points 115 and 116 between the upper and lower side rail members 113 and 114 and the support arms 108 are disposed to ensure that the distance between the connection points 115 and 116 in the vertical direction becomes longest during the ascending and descending motion of the side rail members 113 and 114 by the pivotally rotational motion of the support arms 108 as described above. So, the distance between the top edge of the upper side rail member 113 and the bottom edge of the lower side rail member 114 does not monotonously increase in the motion from the stored position to the service position, but becomes maximum during the motion and becomes smaller again. Therefore, it can be avoided that the distance between the bottom edge of the upper side rail member 113 and the top edge of the lower side rail member 114, i.e., the gap between the respective side rail members 113 and 114 becomes too large.

Figure 4:
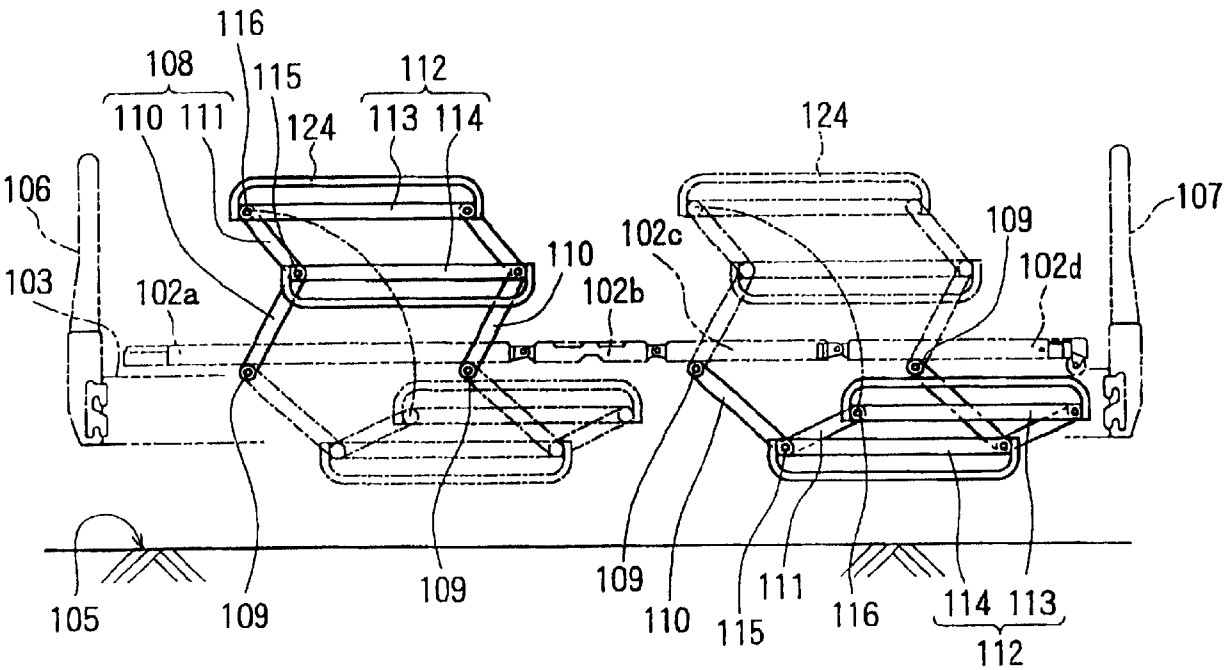
FIG. 4 is a side view showing another preferred embodiment, in which the lifting mechanism for side rails of this invention is applied to a bed.

FIG. 4 shows a second preferred embodiment, in which the lifting mechanism for side rails of this invention is applied to a bed. This second preferred embodiment is generally different from the first preferred embodiment in the forms of the upper side rail member and the lower side rail member, the connection points between the respective side rail members and the support arms, and the ascending and descending directions of the side rail on the head board side, but remains identical in the other basic configuration. Therefore, in FIG. 4 showing the second preferred embodiment, the same components as those of the first preferred embodiment are indicated by the same symbols, to avoid double explanation.

The constitution of the second preferred embodiment different from the first preferred embodiment as described above is described below.

In the second preferred embodiment, the support arms on the head board 106 side are pivotally rotated clockwise to descend and pivotally rotated counterclockwise to ascend, like the support arms 108 on the foot board 107 side.

Furthermore, the side rails proper 112 on the head board 106 side and the foot board 107 side respectively similarly consist of an upper side rail member 113 and a lower side rail member 114, but these side rail members 113 and 114 are formed as horizontally long frames. They do not have any vertically expanded portion on the sides facing each other, i.e., on the bottom edge of the upper side rail member 113 and the top edge of the lower side rail member 114 and are simply formed as straight frames.

The connection points 115 and 116 between the support arms 108 and the side rail members 113 and 114 are provided at both the horizontal ends of the respective side rail members 113 and 114.

The ascending and descending actions of these support arms 108 and the respective side rail members 113 and 114 in this constitution are not described here, since they are obvious from the detailed description of the first preferred embodiment and the depiction in FIG. 4.

Also in this constitution, as can be seen from FIG. 4, the distance between the top edge of the upper side rail member 113 and the bottom edge of the lower side rail member 114, i.e., the vertical height of the side rail proper 112 is smaller in the stored condition than in the service condition. In other words, the vertical height of the side rail proper 112 which is small in the stored condition becomes large in the service condition.

In addition, in this preferred embodiment, since any upwardly open space is not formed outside the support arms 108 below the side rails proper 112, it is not necessary to consider the dimension indicated by F of FIG. 8 described in the explanation of a standard for dimensions of side rails.

Figure 5:
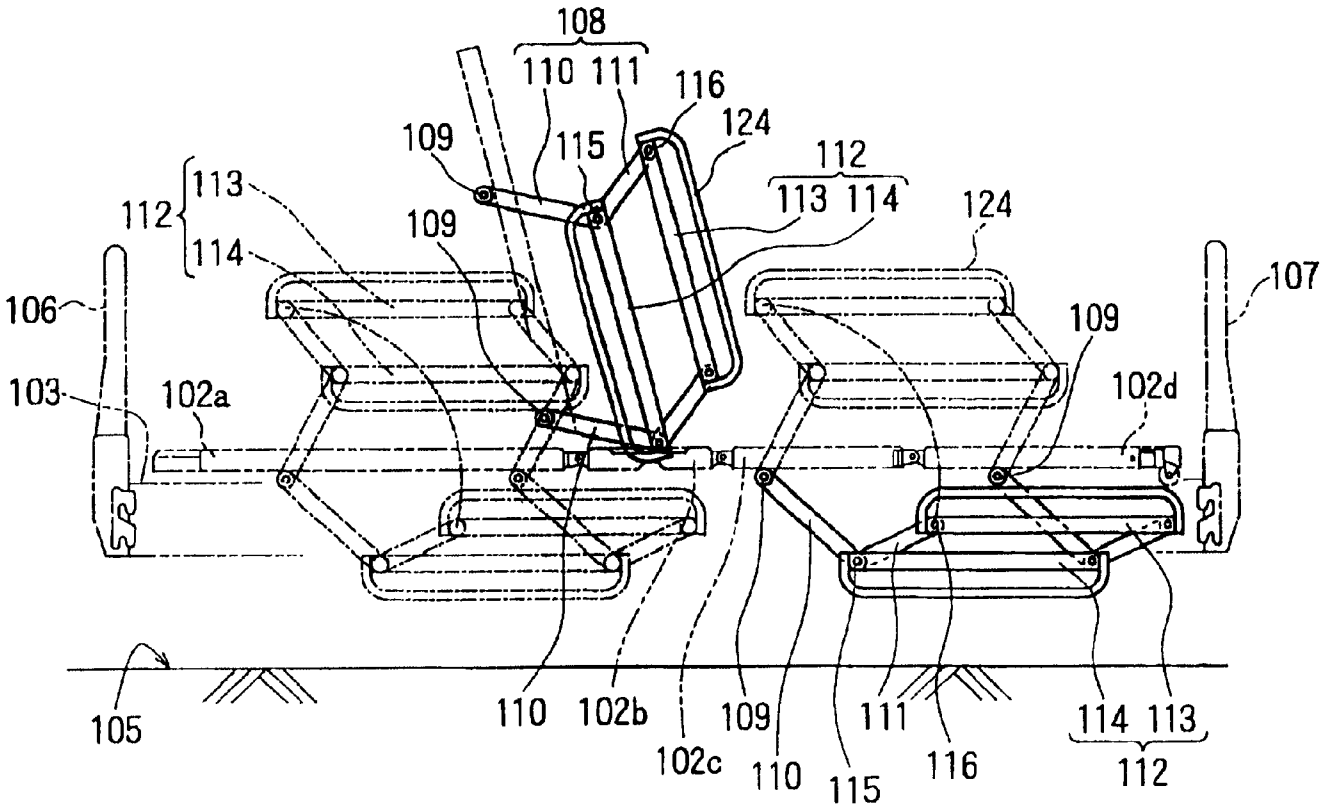
FIG. 5 is a side view showing a further other preferred embodiment, in which the lifting mechanism for side rails of this invention is applied to a bed.

FIG. 5 shows a third preferred embodiment, in which the lifting mechanism for side rails of this invention is applied to a bed. The third preferred embodiment is generally different from the second preferred embodiment only in the support arm installing positions of the side rail on the head board 106 side, and is identical in the other basic constitution. So, In FIG. 5 showing the third preferred embodiment, the same components as those of the second preferred embodiment are indicated by the same symbols, to avoid double explanation.

In the second preferred embodiment, the support arms 108 as components of the side rail on the head board 106 side are pivotally rotatably supported on the deck support frame 103, but in this third preferred embodiment, the support arms 108 as components of the side rail on the head board 106 side are not supported on the deck support frame 103, but pivotally rotatably supported on the deck portion 102*a* adapted to be liftable relatively to the deck support frame 103.

In this configuration, the side rail proper 112 on the head board 106 side can be used in the service condition, not only when the deck portion 102*a* remains horizontal, but also when the deck portion 102*a* is raised by pivotal rotation.

Figure 6:
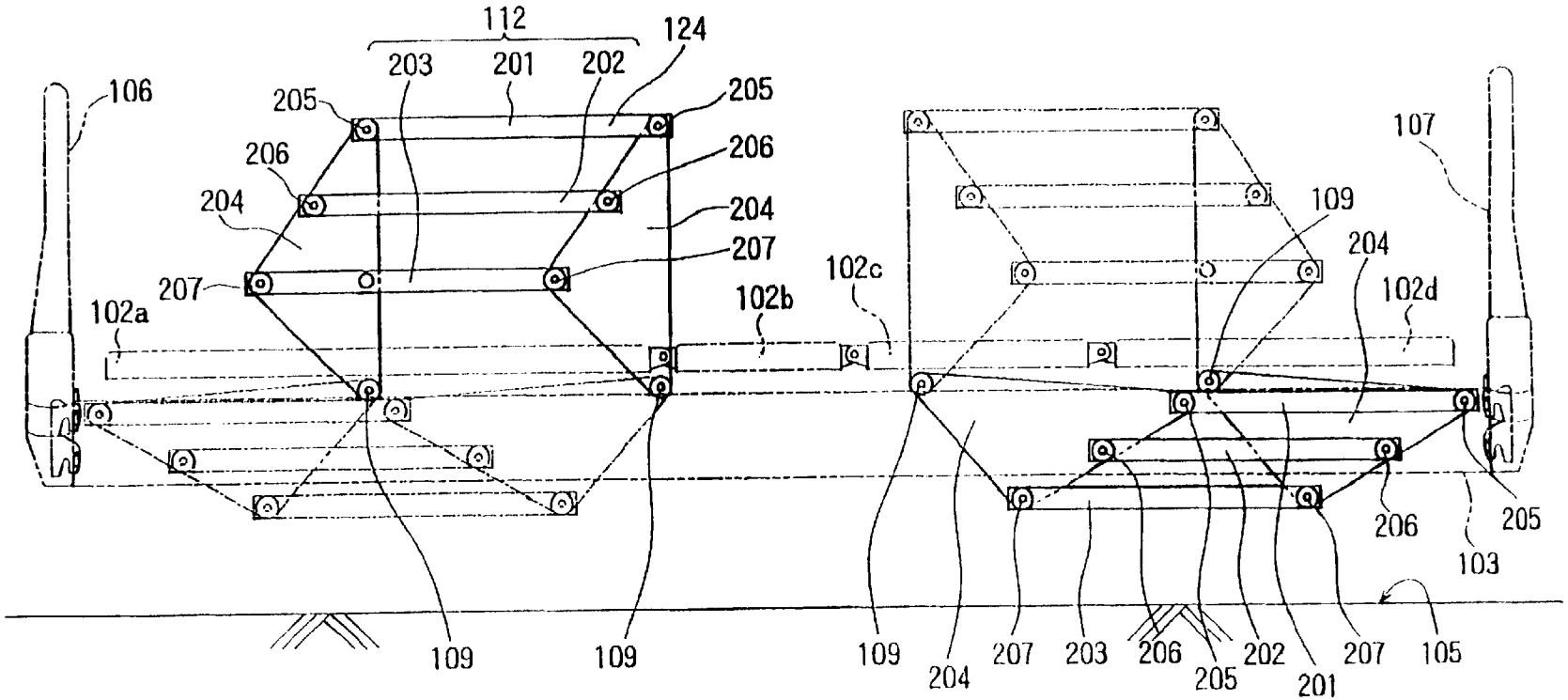
FIG. 6 is a side view showing a still further other preferred embodiment, in which the lifting mechanism for side rails of this invention is applied to a bed.

FIG. 6 shows a fourth preferred embodiment, in which the lifting mechanism for side rails of this invention is applied to a bed. The fourth preferred embodiment is generally different from the first preferred embodiment in the forms and number of side rail members and the form of support arms respectively constituting the side rail proper, and is identical in the other basic constitution. So, also in FIG. 6 showing the fourth preferred embodiment, the same components as those of the first preferred embodiment are indicated by the same symbols, to avoid double explanation.

In this preferred embodiment, each of the side rails proper 112 consists of three rails 201, 202 and 203, and the support arms 204 connecting these rails respectively at both the ends are triangular plates, not the bent links in the above mentioned preferred embodiments.

Also in this constitution, as illustrated, among the connection points 205, 206 and 207 between the support arms 204 and the rails 201, 202 and 203, when the rails 201, 202 and 203 are moved to descend by the pivotally rotational motion of the support arms 204, the connection points 205 and 206 with the upper rails 201 and 202 are disposed to make pivotally rotational motion relatively delayed in phase, with the connection points 207 with the lowest rail 203 as the fulcrums, and this disposition can provide the actions similar to those of the first preferred embodiment.

The ascending and descending actions of the support arms 204 and the rails 201, 202 and 203 in this constitution are not described here, since they are obvious from the detailed description of the first preferred embodiment and the depiction in FIG. 6.

Figure 7:
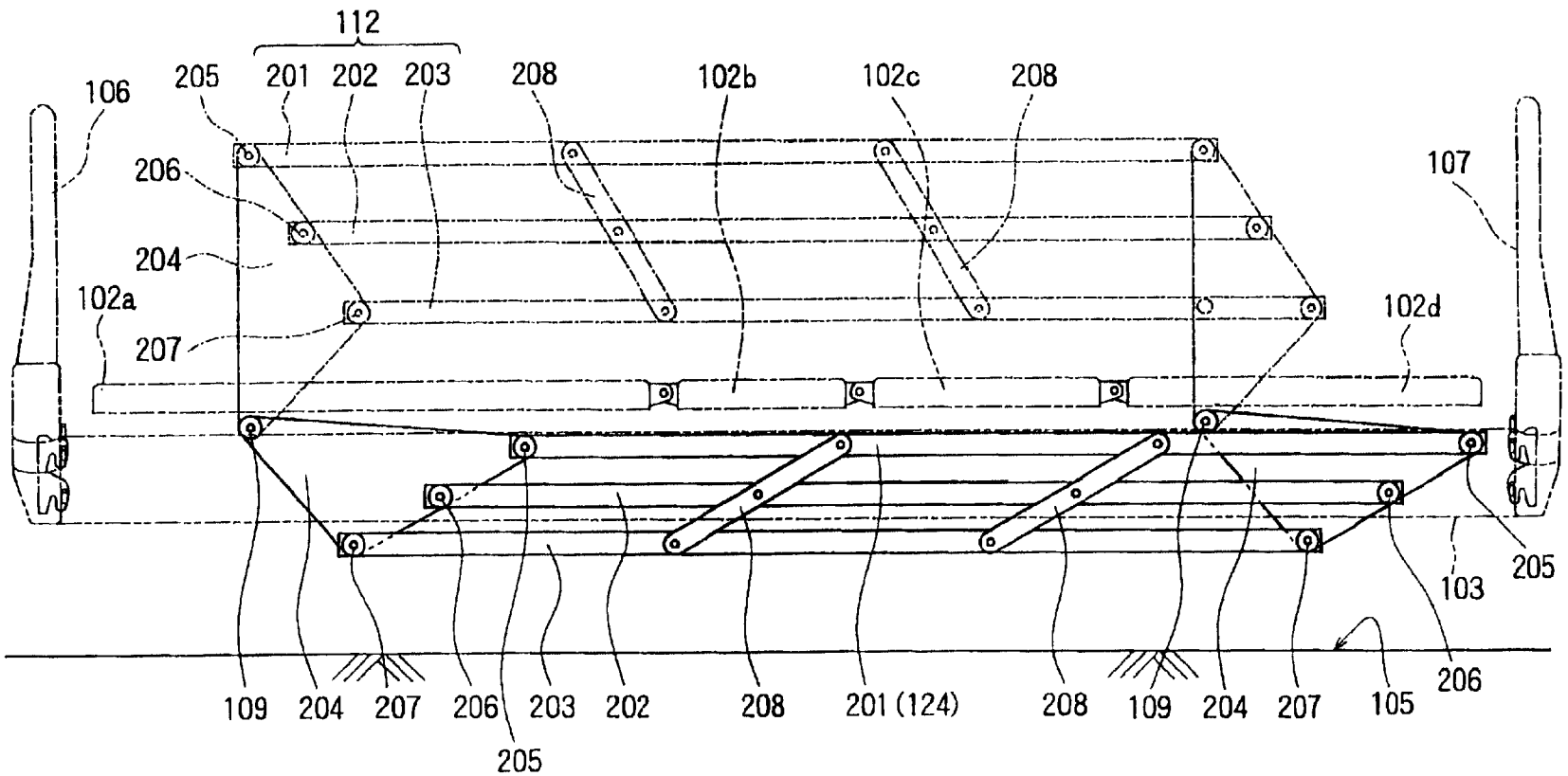
FIG. 7 is a side view showing a still further other preferred embodiment, in which the lifting mechanism for side rails of this invention is applied to a bed.

FIG. 7 shows a fifth preferred embodiment, in which the lifting mechanism for side rails of this invention is applied to a bed. The fifth preferred embodiment is generally different from the fourth preferred embodiment, in that the fourth preferred embodiment covers a lateral side of the bed entirely by two partial side rails proper while the fifth preferred embodiment covers a lateral side of the bed entirely by one side rail. Both the embodiments are identical in the other basic constitution. So, also in FIG. 7 showing the fifth preferred embodiment, the same components as those of the fourth preferred embodiment are indicated by the same symbols, to avoid double explanation.

In this preferred embodiment, to constitute a full side rail, the rails 201 and 202 and 203 are longer and pivotally rotatably supported by a pair of support arms 204 on the head board 106 side and the foot board 107 side.

The ascending and descending actions of the support arms 204 and the rails 201, 202 and 203 in this constitution are not described either, since they are obvious from the above detailed explanation and the depiction in FIG. 7.

When a full side rail like this is constituted, a proper number of connecting links 208 can be connected, as required, as shown in FIG. 7, at intermediate portions of the rails 201, 202 and 203, to form a parallel motion link mechanism.

The connecting links 208 reinforce the long rails 201, 202 and 203 and allow the support arms to be smoothly pivotally rotated to ascend and descend.

In the above second through fifth preferred embodiments, the holding mechanism for holding the side rails proper at the service position and the stored position are neither illustrated nor described, but the same holding mechanism as used in the first preferred embodiment can be applied.

In all of the first to fifth preferred embodiments, any other proper mechanism which can fix the side rails proper at the service position and the stored position can be used as the holding mechanism, needless to say.

INDUSTRIAL APPLICABILITY

The present invention relates to side rails disposed above the deck on one lateral side for preventing the bedding such as a bed quilt and a user such as a patient from falling, particularly a lifting mechanism for liftable side rails, in which side rails proper can be lifted and lowered between the service position above the deck and the stored position below the deck. This lifting mechanism has the following advantages.

(a). In a liftable side rail, in which the side rail proper is moved in parallel to ascend and descend by the pivotal rotation of support arms, the contradictory challenge of keeping the bed deck height low and keeping the distance between the bottom edge of the side rail proper and the floor surface at the stored position can be solved, and even a bed with a low deck height can have a side rail proper with a sufficient height and allows the distance between the bottom edge of the side rail proper and the floor surface to be kept large.

(b). The motion pattern in the ascending and descending of a plurality of side rail members constituting a side rail can be adjusted as desired by adjusting the connection points between support arms and the respective side rail members.

What is claimed is:

1. A lifting mechanism for liftable side rails for a lying table such as a bed, comprising each of the side rails proper, consisting of a plurality of vertically disposed side rail members, the plurality of side rail members, being pivotally rotatably connected, on the respectively both horizontal sides thereof, with a pair of support arms pivotally rotatably supported at side rail installation points of the lying table such as a bed, to be supported in such a manner that the side rail members may be lifted and lowered by the pivotally rotational motion of these support arms along the pivotally rotational loci, and the connection points between the support arms and the side rail members, being disposed in such a manner that the connection points of the upper side rail member make pivotally rotational motion relatively delayed in phase, with the connection points of the lowest side rail member as the fulcrums, when the side rail members are moved to descend by the pivotally rotational motion of the support arms.

2. A lifting mechanism for liftable side rails for a lying table such as a bed, according to claim 1, wherein the connection points between the respective side rail members and the support arms are disposed in such a manner that the distances between the respective connection points in the vertical direction become longest during the descending motion of the side rail members by the pivotally rotational motion of the support arms.

3. A lifting mechanism for liftable side rails for a lying table such as a bed, according to claim 1, wherein said plurality of side rail members are connected with the support arms, to form a parallel motion link mechanism.

4. A lifting mechanism for liftable side rails for a lying table such as a bed, according to claim 1, wherein the side rail consists of three or more rail-shaped side rail members.

5. A lifting mechanism for liftable side rails for a lying table such as a bed, according to claim 4, wherein a connecting link is connected between the intermediate points of the rail-shaped side rail members, to form a parallel motion link mechanism together with the support arms on both sides.

6. A lifting mechanism for liftable side rails for a lying table such as a bed, according to claim 1, wherein the support arms are connected with the ends of the respective side rail members.

7. A lifting mechanism for liftable side rails for a lying table such as a bed, according to claim 1, wherein each of the support arms is a bent link, in which, from the tip of a first arm portion extending from the side rail installing point of the lying table such as a bed to the lowest side rail member, a second arm portion is protruded toward the rear side of the pivotally rotational descending motion.

8. A lifting mechanism for liftable side rails for a lying table such as a bed, according to claim 1, wherein each of the support arms is formed as a plate having the side rail installation point at the lying table such as a bed and the connection points with the respective side rail members.

9. A lifting mechanism for liftable side rails for a lying table such as a bed, according to claim 1, wherein one side rail is provided to cover a lateral side entirely.

10. A lifting mechanism for liftable side rails for a lying table such as a bed, according to claim 2, wherein said plurality of side rail members are connected with the support arms, to form a parallel motion link mechanism.

11. A lifting mechanism for liftable side rails for a lying table such as a bed, according to claim 2, wherein the side rail consists of three or more rail-shaped side rail members.

12. A lifting mechanism for liftable side rails for a lying table such as a bed, according to claim 3, wherein the side rail consists of three or more rail-shaped side rail members.

13. A lifting mechanism for liftable side rails for a lying table such as a bed, according to claim 2, wherein the support arms are connected with the ends of the respective side rail members.

14. A lifting mechanism for liftable side rails for a lying table such as a bed, according to claim 1, wherein each of the support arms is a bent link, in which, from the tip of a first arm portion extending from the side rail installing point of the lying table such as a bed to the lowest side rail member, a second arm portion is protruded toward the rear side of the pivotally rotational descending motion.

15. A lifting mechanism for liftable side rails for a lying table such as a bed, according to claim 1, wherein each of the support arms is formed as a plate having the side rail installation point at the lying table such as a bed and the connection points with the respective side rail members.

16. A lifting mechanism for liftable side rails for a lying table such as a bed, comprising each of the side rails proper consisting of vertically disposed two side rail members, said side rail members being pivotally rotatable connected on both horizontal sides thereof, with a pair of support arms pivotally rotatable supported at side rail installation points of the lying table such as a bed, to be supported in such a manner that the side rail members may be lifted and lowered by a pivotal rotational motion of these support arms along a pivotal rotational loci, and connection points between support arms and side rail members being disposed in such a manner that connection points of upper side rail members make a pivotal rotational motion relatively delayed in phase with connection points of a lowest side rail member as fulcrums when the side rail members are moved to descend by pivotal rotational motion of the support arms, a lower side rail member having an outside form of being smaller in vertical height on a front side of the descending motion, than on the rear side, and having a step to make a vertically extended portion at the top on the rear side, while an upper side rail member has an external form of being larger in vertical height on a front side than on the rear side, and having a step to make a vertically extended portion at the bottom on the rear side.

17. A lifting mechanism for liftable side rails for a lying table such as a bed, according to claim 16, wherein two side rails are provided on the front and rear sides at one lateral side of the lying table such as a bed, to cover the lateral side entirely.

18. A lifting mechanism for liftable side rails for a lying table such as a bed, according to claim 17, wherein the side rails on the front and rear sides can be lowered to keep the side rails proper thereof stored near the ends of the lying table such as a bed.

19. A lifting mechanism for liftable side rails for a lying table such as a bed, comprising each of the side rails proper consisting of vertically disposed two side rail members, said side rail members being pivotally rotatable connected on both horizontal sides thereof, with a pair of support arms pivotally rotatable supported at side rail installation points of the lying table such as a bed, to be supported in such a manner that the side rail members may be lifted and lowered by a pivotal rotational motion of these support arms along a pivotal rotational loci, and connection points between support arms and side rail members being disposed in such a manner that connection points of upper side rail members make a pivotal rotational motion relatively delayed in phase with connection points of a lowest side rail member as fulcrums when the side rail members are moved to descend by pivotal rotational motion of the support arms, said connection points between respective side rail members and the support arms being disposed in such a manner that distances between the respective connection points in the vertical direction become longest during a descending motion of side rail members by pivotal rotational motion of the support arms, a lower side rail member having an outside form of being smaller in vertical height on a front side of the descending motion, than on the rear side, and having a step to make a vertically extended portion at a top on the rear side, while an upper side rail member has an external form of being larger in vertical height on the front side than on the rear side, and having a step to make a vertically extended portion at a bottom on the rear side.

20. A lifting mechanism for liftable side rails for a lying table such as a bed, comprising each of the side rails proper consisting of vertically disposed two side rail members, said side rail members being pivotally rotatably connected on both horizontal sides thereof, with a pair of support arms pivotally rotatably supported at side rail installation points of the lying table such as a bed, to be supported in such a manner that the side rail members may be lifted and lowered by a pivotal rotational motion of these support arms along a pivotal rotational loci, and connection points between support arms and side rail members being disposed in such a manner that connection points of upper side rail members make a pivotal rotational motion relatively delayed in phase with connection points of a lowest side rail member as fulcrums when the side rail members are moved to descend by pivotal rotational motion of the support arms, said plurality of side rail members being connected with the support arms to form a parallel motion link mechanism, a lower side rail member having an outside form of being smaller in vertical height on a front side of the descending motion, than on the rear side, and having a step to make a vertically extended portion at a top on the rear side, while an upper side rail member has an external form of being larger in vertical height on the front side than on the rear side, and having a step to make a vertically extended portion at a bottom on the rear side.

* * * * *